US007782273B2

(12) United States Patent
Morikawa

(10) Patent No.: US 7,782,273 B2
(45) Date of Patent: Aug. 24, 2010

(54) ANTENNA CONNECTING STRUCTURE AND ANTENNA CONNECTING METHOD

(75) Inventor: Taishi Morikawa, Makinohara (JP)

(73) Assignee: Yazaki Corporation, Tokyo (JP)

( * ) Notice: Subject to any disclaimer, the term of this patent is extended or adjusted under 35 U.S.C. 154(b) by 180 days.

(21) Appl. No.: 12/199,885

(22) Filed: Aug. 28, 2008

(65) Prior Publication Data

US 2009/0058759 A1 Mar. 5, 2009

(30) Foreign Application Priority Data

Aug. 29, 2007 (JP) ..... 2007-222493

(51) Int. Cl.
*H01Q 1/50* (2006.01)

(52) U.S. Cl. ..... 343/906; 343/711

(58) Field of Classification Search ..... 343/906, 343/711, 713; 439/63, 98, 581; 174/102 R, 174/103, 36

See application file for complete search history.

(56) References Cited

U.S. PATENT DOCUMENTS 4,231,041 A * 10/1980 Graeser et al. ..... 343/767
5,738,529 A * 4/1998 Wedell et al. ..... 439/63
5,739,471 A * 4/1998 Burisch ..... 174/102 R
2007/0074385 A1 * 4/2007 Ikegaya et al. ..... 29/600

FOREIGN PATENT DOCUMENTS

JP 2006-41360 A 2/2006

* cited by examiner

*Primary Examiner*—Hoang V Nguyen
(74) *Attorney, Agent, or Firm*—Sughrue Mion, PLLC

(57) ABSTRACT

An antenna connecting structure includes a shielded cable including: a core wire; an inner sheath covering the core wire; a shielding member covering the inner sheath; and an outer sheath covering the shielding member, wherein one end of the core wire, the inner sheath and the shielding member are exposed at one end of the shielded cable in the longitudinal direction, an antenna member including: a dielectric body; and an antenna conductor which has an antenna portion molded in the dielectric body, and a terminal portion formed integrally with the antenna portion and press-clamped or press-contacted to the one end portion of the core wire, and a conductive ground terminal including: a receiving portion for holding the dielectric body so that the ground terminal does not contact the antenna conductor and the core wire; a shielding member grasping portion for grasping one end of the shielding member.

7 Claims, 4 Drawing Sheets

ANTENNA CONNECTING STRUCTURE AND ANTENNA CONNECTING METHOD

BACKGROUND OF THE INVENTION

1. Technical Field

This invention relates to an antenna connecting structure and an antenna connecting method for an antenna device mounted in a vehicle such as an automobile, and more particularly to the connection between a shielded cable (connected to a circuit such as a feeder circuit and a transmit-receive circuit) and an antenna conductor of the antenna device.

2. Background Art

Conventionally, a vehicle such for example as an automobile is equipped with an antenna device (serving as a radio antenna (AM•FM), a television antenna or the like) having an antenna conductor of a predetermined shape affixed to the vehicle. For example, in the case where such an antenna device is used as a radio antenna, a coaxial cable is usually used to connect the antenna conductor to a circuit such as a feeder circuit and a transmit-receive circuit mounted on a vehicle body.

The coaxial cable is a kind of shielded cable, and is of a multi-layer construction including a core wire (conductor), an inner sheath covering an outer peripheral surface of the core wire and extending in a longitudinal direction of the core wire, a shielding member covering an outer peripheral surface of the inner sheath and extending in the longitudinal direction, and an outer sheath covering an outer peripheral surface of the shielding member and extending in the longitudinal direction.

Therefore, when this coaxial cable is to be connected to the antenna conductor, first, part of the outer sheath is cut off or removed so as to expose one end portion of the shielding member, and then part of the shielding member is removed so as to expose one end portion of the inner sheath, and then part of the inner sheath is removed so as to expose one end portion of the core wire. In this exposed condition, the coaxial cable and the above circuit are connected together at their relevant portions usually by soldering (see, for example, Patent Literature 1).

More specifically, in an antenna connecting structure 100 disclosed in Patent Literature 1, a coaxial cable 101 is used as a feeder for connecting an antenna conductor (antenna radiation conductor) of an on-board high-frequency equipment to a feeder circuit as shown in FIG. 4, and this feeder circuit is provided on a circuit board 102. This coaxial cable 101 includes a core wire (inner conductor) 103 provided at a center portion thereof, and an inner sheath (inner insulating layer) 104 covering an outer peripheral surface of the core wire 103. The coaxial cable 101 further includes a shielding member (outer conductor) 105 in the form of a braid covering an outer peripheral surface of the inner sheath 104, and an outer sheath (outer covering member) 106 covering an outer peripheral surface of the shielding member 105.

A signal wiring-purpose soldering land 107 (to which the core wire 103 of the coaxial cable 101 is adapted to be soldered) and a grounding-purpose soldering land 108 (to which the shielding member 105 is adapted to be soldered) are formed on a surface of the circuit board 102, and are spaced a predetermined distance from each other.

The core wire 103 of the coaxial cable 101 is connected by solder 107*a* to the signal wiring-purpose soldering land 107, and the shielding member 105 is connected by solder 108*a* to the grounding-purpose soldering land 108.

The signal wiring-purpose soldering land 107 is connected to the feeder circuit (not shown), and the grounding-purpose soldering land 108 is connected to the ground (not shown).

[Patent Literature 1] JP-A-2006-41360 (FIG. 1)

When connecting the coaxial cable (shielded cable) 101 to the antenna device as shown in Patent Literature 1, the connection of the core wire 103 to the antenna conductor, as well as the connection of the shielding member 105 to the ground, is usually effected by soldering, and therefore there has been encountered a problem that much time is required for this connecting operation.

Furthermore, the amount of solder used in the soldering operation affects an antenna performance (for example, an impedance), and therefore the amount of the solder must be controlled, and this is cumbersome and may lead to a possibility that the efficiency of the operation is lowered.

SUMMARY OF THE INVENTION

This invention has been made in view of the above circumstances, and an object of the invention is to provide an antenna connecting structure and an antenna connecting method, in which an antenna conductor can be easily connected to a shielded cable in a short time.

The object of the invention has been achieved by the following construction.

(1) An antenna connecting structure, including:

a shielded cable including: a core wire; an inner sheath covering an outer peripheral surface of the core wire and extending in a longitudinal direction of the core wire; a shielding member covering an outer peripheral surface of the inner sheath and extending in the longitudinal direction; and an outer sheath covering an outer peripheral surface of the shielding member and extending in the longitudinal direction, wherein one end portions of the core wire, the inner sheath and the shielding member are exposed at one end portion of the shielded cable in the longitudinal direction;

an antenna member including: a dielectric body; and an antenna conductor which has an antenna portion molded in the dielectric body, and a terminal portion formed integrally with the antenna portion and press-clamped or press-contacted to the one end portion of the core wire to be electrically connected to the core wire; and a ground terminal, made of conductive metal, including: a receiving portion for holding the dielectric body so that the ground terminal is not in contact with the antenna conductor and the core wire; a shielding member grasping portion for grasping one end portion of the shielding member to electrically connect to the shielding member.

(2) The antenna connecting structure according to (1), wherein the ground terminal includes an outer sheath grasping portion for grasping one end portion of the outer sheath.

(3) The antenna connecting structure according to (1), wherein a holding claw is provided on the receiving portion to hold the antenna member.

(4) The antenna connecting structure according to (1), further including a connector housing which receives the ground terminal and part of a bracket electrically connected to an external ground, wherein a bracket contact portion is formed on the ground terminal; and wherein when the ground terminal and the bracket are received in the connector housing, the bracket contact portion contacts the bracket so that the ground terminal is electrically connected to the bracket.

(5) An antenna connecting method, including:

preparing a shielded cable including a core wire; an inner sheath covering an outer peripheral surface of the core wire and extending in a longitudinal direction of the core wire; a shielding member covering an outer peripheral surface of the inner sheath and extending in the longitudinal direction; and an outer sheath covering an outer peripheral surface of the shielding member and extending in the longitudinal direction, wherein one end portions of the core wire, the inner sheath and the shielding member are exposed at one end portion of the shielded cable in the longitudinal direction, preparing an antenna member including: a dielectric body; and an antenna conductor which has an antenna portion molded in the dielectric body and a terminal portion formed integrally with the antenna portion, and preparing a ground terminal, made of conductive metal, including: a receiving portion for holding the dielectric body so that the ground terminal is not in contact with the antenna conductor and the core wire; and a shielding member grasping portion for grasping the one end portion of the shielding member to electrically connect to the shielding member;

electrically connecting the core wire to the terminal portion of the antenna member by press-clamping or press-contacting;

attaching the ground terminal to the dielectric body so that the dielectric body is received in the receiving portion; and grasping the shielding member by the shielding member grasping portion.

(6) The antenna connecting method according to (5), further including: preparing the ground terminal provided with an outer sheath grasping portion for grasping one end portion of the outer sheath; and grasping the outer sheath by the outer sheath grasping portion.

(7) The antenna connecting method according to (5), further including: preparing the ground terminal provided with a bracket contact portion; receiving the ground terminal and part of a bracket connected to an external ground in a connector housing; and contacting the bracket contact portion with the bracket so as to electrically connect the ground terminal to the bracket.

In the antenna connecting structure of the above configurations, the antenna conductor which can be connected by press-clamping or press-contacting to the core wire of the shielded cable is insert-molded in the dielectric body to form the antenna member, and the ground terminal can be electrically connected to the shielding member of the shielded cable through the shielding member grasping portion of the ground terminal. Therefore, the antenna member and the ground terminal can be easily connected to the shielded cable in a short time without the need for paying any attention to the amount of solder as in the conventional connecting structure using a soldering operation. Furthermore, the antenna portion of the antenna conductor is insert-molded in the dielectric body, and therefore the deformation of the antenna conductor can be prevented, and besides a change in inductance value can be greatly suppressed.

In the antenna connecting structure of the above configurations, there is further provided the connector housing which receives the ground terminal and part of the bracket electrically connected to the predetermined external ground, and the bracket contact portion is formed at the ground terminal. Therefore, when the ground terminal and the bracket are received in the connector housing, the bracket contact portion contacts the bracket, so that the ground terminal is electrically connected to the bracket, and therefore the ground terminal can be easily electrically connected to the ground in a short time.

In the antenna connecting method of the above configurations, the antenna member is connected by press-clamping or press-contacting to the core wire of the shielded cable, and the ground terminal is electrically connected to the shielding member of the shielded cable through the shielding member grasping portion of the ground terminal (having the dielectric body of the antenna member received therein). Therefore, the antenna member and the ground terminal can be easily connected to the shielded cable in a short time without the need for paying any attention to the amount of solder as in the conventional connecting structure using the soldering operation. Furthermore, when the ground terminal and the bracket are received in the connector housing, the bracket contact portion contacts the bracket, so that the ground terminal is electrically connected to the bracket, and therefore the ground terminal can be easily electrically connected to the ground in a short time.

In the present invention, there can be provided the antenna connecting structure and the antenna connecting method, in which the antenna conductor can be easily connected to the shielded cable in a short time.

BRIEF DESCRIPTION OF THE DRAWINGS

The above objects and advantages of the present invention will become more apparent by describing in detail preferred exemplary embodiments thereof with reference to the accompanying drawings, wherein like reference numerals designate like or corresponding parts throughout the several views, and wherein.

DETAILED DESCRIPTION OF THE PREFERRED EMBODIMENTS

A preferred embodiment of the present invention will now be described in detail with reference to the drawings.

Figure 1:
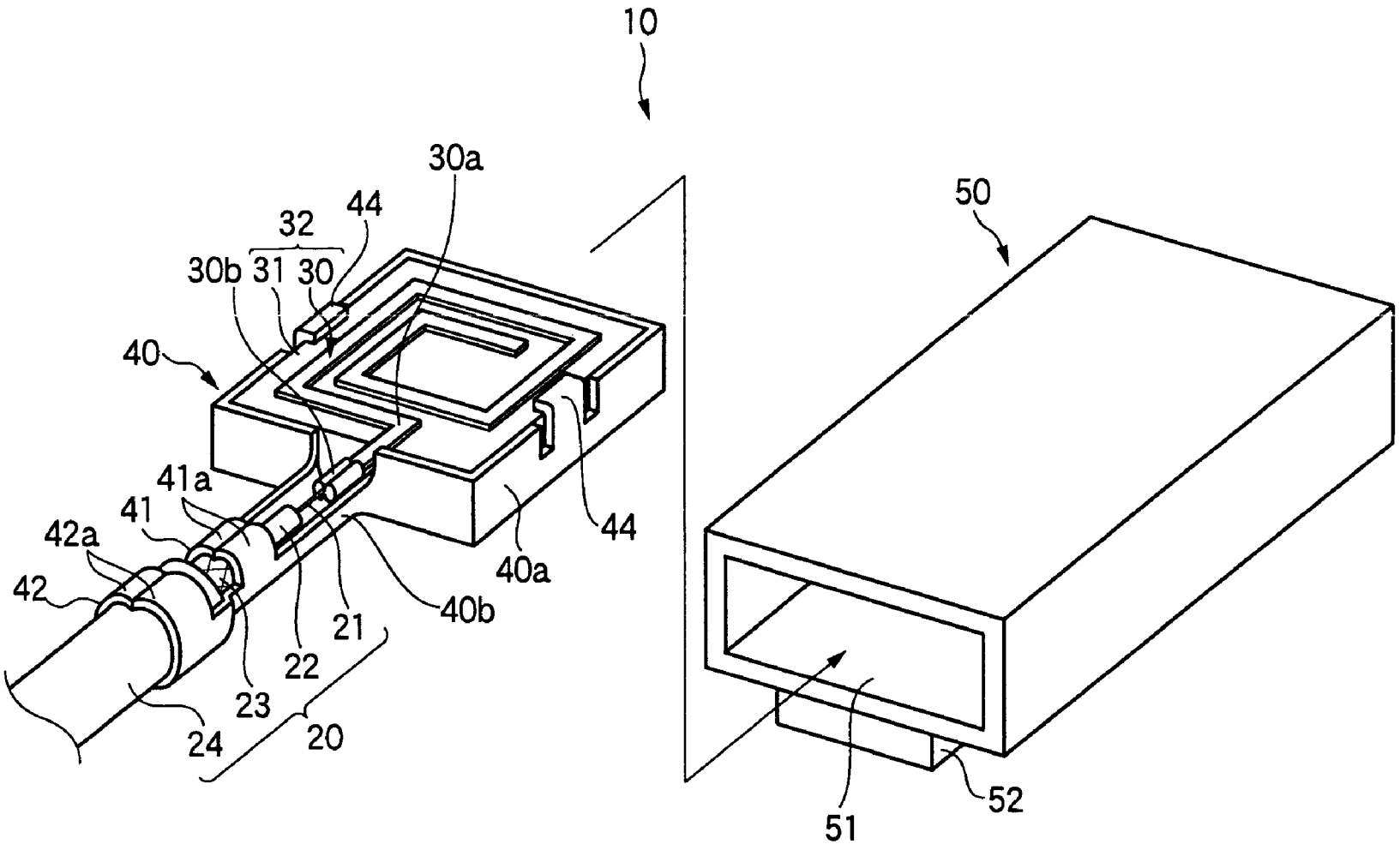
FIG. 1 is a perspective view showing a preferred embodiment of an antenna connecting structure of the present invention as well as an antenna connecting method of the invention.
Figure 2A:
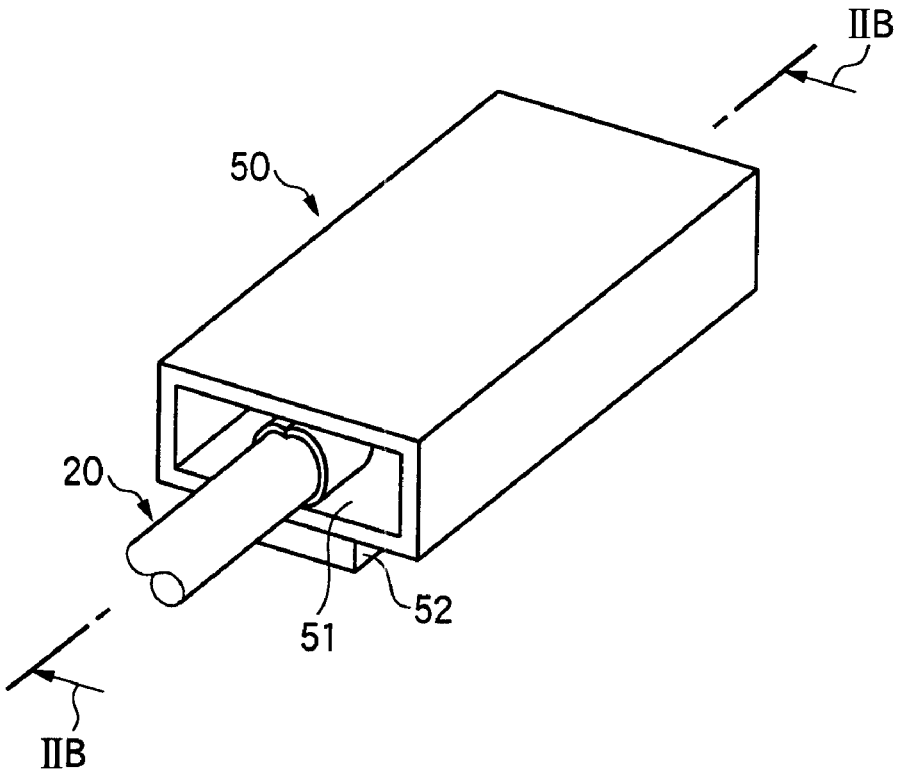
FIG. 2A is a perspective view showing a condition in which an antenna is received within a connector housing.
Figure 2B:
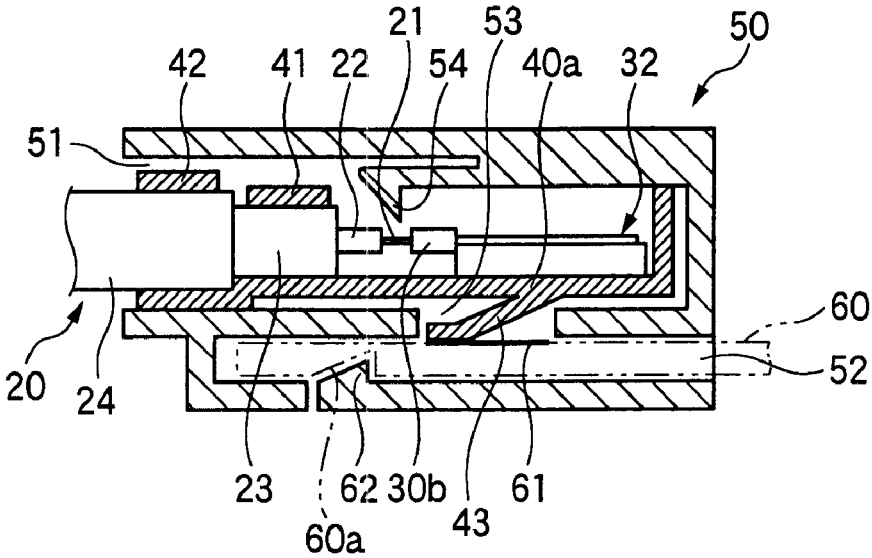
FIG. 2B is a cross-sectional view taken along the line IIB-IIB of FIG. 2A.

FIG. 1 is a perspective view showing a preferred embodiment of an antenna connecting structure of the invention as well as an antenna connecting method of the invention, FIG. 2A is a perspective view showing a condition in which an antenna is received within a connector housing, FIG. 2B is a cross-sectional view taken along the line IIB-IIB of FIG. 2A, and FIGS. 3A to 3E are views showing the steps of the antenna connecting method.

In this embodiment, a coaxial cable is used as a shielded cable, and includes a core wire (conductor), an inner sheath (insulator) covering the core wire, a braid (which is a mesh-like conductor (i.e., a shielding member)) covering the inner sheath, and an outer sheath covering the braid so as to protect the interior of the coaxial cable from an external impact or the like.

Figure 3A:
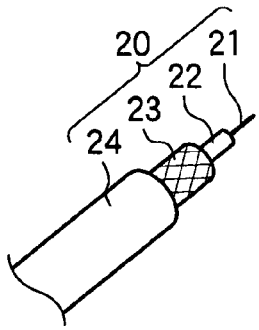
FIGS. 3A to 3E are views showing the steps of the antenna connecting method.

As shown in FIG. 1, at one end portion of the coaxial cable 20, part of the outer sheath 24 is cut off or removed so as to expose one end portion of the braid (shielding member) 23, and then part of the braid 23 is removed so as to expose one end portion of the inner sheath 22, and then part of the inner sheath 22 is removed so as to expose one end portion of the core wire 21 (see FIG. 3A). In this exposed condition, the coaxial cable 20 is connected to an antenna device 10 of this embodiment. This antenna device 10 includes an antenna conductor 30, and this antenna conductor 30 includes an antenna portion 30*a*, and a terminal portion 30*b* formed at one end of the antenna portion 30*a* so as to be connected by press-clamping (crimping) to the core wire 21. The antenna portion 30*a* of the antenna conductor 30 is insert-molded in a dielectric body 31 to form an antenna member 32 as will hereafter be more fully described.

The connection of the core wire 21 to the antenna conductor 30 may be made by press-contacting instead of press-clamping. The other end portion of the coaxial cable 20 is connected to a ground layer on a circuit board (not shown) having a circuit such as a feeder circuit and a transmit-receive circuit.

The terminal portion 30*b* is made, for example, of electrically-conductive metal, and has a cylindrical shape having an internal space into which the core wire 21 can be inserted, the terminal portion 30*b* being formed integrally with the antenna portion 30*a*. The terminal portion 30*b* has a slit extending in a direction of inserting of the core wire 21. Therefore, after the core wire 21 is inserted into the terminal portion 30*b*, the terminal portion 30*b* is press-deformed by the use of a tool such as pliers, and as a result the internal space of this terminal portion 30*b* is easily closed, so that the terminal portion 30*b* is press-clamped to the one end portion of the core wire 21, and therefore the core wire 21 is electrically connected to the antenna conductor 30.

The terminal portion 30*b* is thus gripped and press-deformed by the tool after the core wire 21 is inserted into the terminal portion 30*b*, and by doing so, the core wire 21 is gripped by the terminal portion 30*b* from the opposite sides thereof, and can be easily connected to the terminal portion 30*b* by this press-clamping operation. Therefore, the antenna member 32 can be easily connected to the coaxial cable 20 in a short time without the need for paying any attention to the amount of solder as in the conventional connecting structure using a soldering operation.

The antenna portion 30*a* of the antenna conductor 30 is insert-molded in an upper surface (FIG. 1) of the dielectric body 31 of a generally rectangular shape made, for example, of a resin or a ceramics material, and as a result the antenna member 32 comprising the dielectric body 31 and the antenna conductor 30 is formed. Therefore, the antenna conductor 30 (more specifically, the antenna portion 30*a*) is prevented from deformation, and besides the wavelength of electromagnetic waves that can be transmitted and received by the antenna member 32 is shortened by a dielectric constant of the dielectric body 31, and therefore the antenna conductor 30 can be reduced in size, so that the overall size of the antenna device 10 can be reduced.

The dielectric body 31 of the antenna member 32 is received in a ground terminal 40. This ground terminal 40 is so formed as to receive and hold the dielectric body 31 therein without contacting the antenna conductor 30 and the core wire 21. Namely, the ground terminal 40 is formed of an electrically-conductive thin metal sheet, for example, by pressing, and includes a receiving portion 40*a* extending perpendicularly upwardly from a peripheral edge of a base plate portion thereof and covering at least one of side faces (four side faces and a bottom face in this embodiment) of a peripheral wall of the antenna member 32 (more specifically, the dielectric body 31). The ground terminal 40 further includes a braided press-clamping portion (shielding member grasping portion) 41 for grasping the braid 23, and an outer sheath press-clamping portion (outer sheath grasping portion) 42 for grasping the outer sheath 24.

The braided press-clamping portion 41 and the outer sheath press-clamping portion 42 are formed on an upper side of an extension portion 40*b* formed on and extends horizontally from one end of the base plate portion of the ground terminal 40, and are juxtaposed to each other in the longitudinal direction of the coaxial cable 20 connected to the antenna member 32.

Part of the base plate portion (bottom plate portion) of the receiving portion 40*a* is stamped out and bent downwardly to form a bracket contact portion 43 (see FIG. 2) which can be resiliently deformed.

A pair of opposed holding claws 44 (see FIG. 3C) are formed respectively at opposed side walls of the receiving portion 40*a*, and are adapted to hold the antenna member 32 against disengagement from the ground terminal 40.

The braided press-clamping portion 41 has a pair of gripping piece portions 41*a*, and the outer sheath press-clamping portion 42 has a pair of gripping piece portions 42*a*, and the gripping piece portions 41*a*, as well as the gripping piece portions 42*a*, grip the coaxial cable 20, disposed therebetween, from the opposite sides. Namely, the coaxial cable 20 is passed through an internal space defined by the pair of gripping piece portions 41*a* and also through an internal space defined by the pair of gripping piece portions 42*a*, and is received in these internal spaces, and in this condition the pair of gripping piece portions 41*a* as well as the pair of gripping piece portions 42*a* are press-deformed from the opposite sides by the use of a tool such as pliers, and by doing so, the braided press-clamping portion 41 is caused to firmly grasp the braid 23 while the outer sheath press-clamping portion 42 is caused to firmly grasp the outer sheath 24.

Therefore, the ground terminal 40 can be easily connected to the braid 23 of the coaxial cable 20 in a short time without the need for paying any attention to the amount of solder as in the conventional connecting structure using the soldering operation, and also the coaxial cable 20 can be positively held by the ground terminal 40.

When the braid 23 is thus grasped by the braided press-clamping portion 41, the braid 23 is electrically connected to the ground terminal 40.

As shown in FIGS. 2A and 2B, the ground terminal 40 can be received or housed in the connector housing 50. The connector housing 50 has a generally rectangular box-shaped body of a double (upper-lower) chamber construction, and includes a ground terminal receiving portion 51 for receiving and holding the ground terminal 40, and a bracket receiving portion 52 for receiving and holding a distal end portion of a bracket 60 connected to the external ground. An elastically-deformable retaining claw 54 is formed on an upper wall of the ground terminal receiving portion 51, and when the ground terminal 40 is received in the ground terminal receiving portion 51, the retaining claw 54 is engaged with at least part of the peripheral wall of the receiving portion 40*a* to prevent the ground terminal 40 from disengagement from the ground terminal receiving portion 51. Also, an elastically-deformable retaining claw 62 for preventing the inserted bracket 60 for disengagement from the bracket receiving portion 52 is formed on a lower wall of the bracket receiving portion 52. A recess 60*a* corresponding in shape to the retaining claw 62 is formed in the distal end portion of the bracket 60, and when the bracket 60 is received in the bracket receiving portion 52, the retaining claw 62 is engaged in the recess 60*a*.

Therefore, the ground terminal 40, when inserted into the ground terminal receiving portion 51 while elastically deforming the retaining claw 54 outwardly, is prevented by the retaining claw 54 from disengagement from the ground terminal receiving portion 51. Also, the bracket 60, when inserted into the bracket receiving portion 52 while elastically deforming the retaining claw 62 outwardly, is prevented by the retaining claw 62 from disengagement from the bracket receiving portion 52. Therefore, the ground terminal 40 (in which the antenna member 32 and the coaxial cable 20 are positively connected to each other) and the bracket 60 are fixedly received in the connector housing 50 against disengagement (or withdrawal) therefrom.

Furthermore, a notch 53 is formed in a partition wall formed between the ground terminal receiving portion 51 and the bracket receiving portion 52 as shown in FIG. 2B, and when the ground terminal 40 is inserted into the ground terminal receiving portion 51, the bracket contact portion 43 formed on the bottom surface of the ground terminal 40 projects through the notch 53 into the bracket receiving portion 52. Therefore, when the bracket 60 is inserted into the bracket receiving portion 52, the bracket contact portion 43 of the ground terminal 40 contacts a ground portion 61 formed on the bracket 60, and therefore the ground terminal 40 of the antenna device 10 can be easily grounded (that is, connected to the ground) in a short time.

Therefore, for example, when a plurality of antenna devices 10 are to be mounted in an automobile, the ground terminal 40 of each antenna device can be more easily connected to the ground in a shorter time merely by inserting the bracket 60 (connected, for example, to a panel of a vehicle body serving as the ground) into the bracket receiving portion 52 of the connector housing 50.

Next, the antenna connecting method of the invention will be described with reference to FIG. 3.

The antenna member 32 and the ground terminal 40 are beforehand prepared, and also there is beforehand prepared the coaxial cable 20 in which one end portions of the core wire 21, the inner sheath 22 and the braid 23 are exposed respectively over predetermined lengths at one end portion (in the longitudinal direction) of the coaxial cable 20 as shown in FIG. 3A (This is a preparatory step.).

Figure 3B:
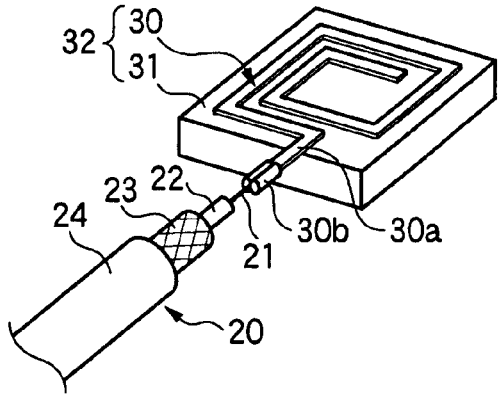

Then, the core wire 21 is inserted into the terminal portion 30*b* of the antenna member 32, and the terminal portion 30*b* is gripped by the tool from the opposite sides thereof, and is press-deformed (crushed) to be press-clamped to the core wire 21, and by doing so, the terminal portion 30*b* is electrically connected to the core wire 21 as shown in FIG. 3B (This is a core wire connecting step.).

Figure 3C:
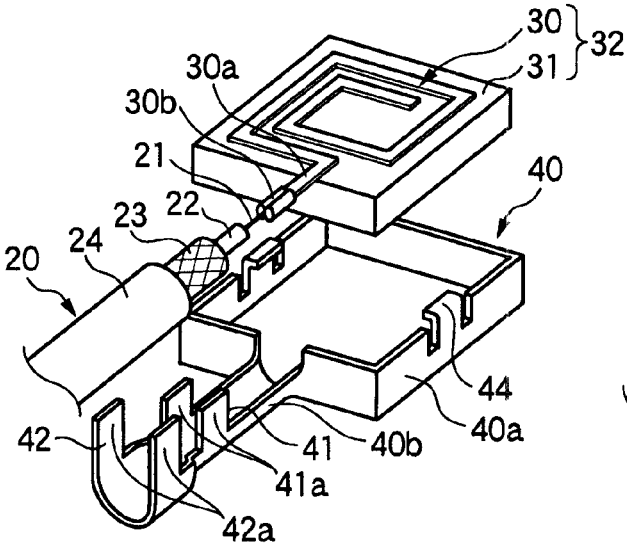

After this core wire connecting step, the ground terminal 40 is attached to the dielectric body 31 of the antenna member 32 such that the dielectric body 31 is received in the receiving portion 40*a* of the ground terminal 40 as shown in FIG. 3C, and the exposed braid 23 and the exposed outer sheath 24 are set (or fitted) respectively in the braided press-clamping portion 41 and the outer sheath press-clamping portion 42 (This is a receiving step.).

At this time, the ground terminal 40 is attached to the antenna member 32 in such a manner that this ground terminal 40 is not in contact with the core wire 21 of the coaxial cable 20 and the terminal portion 30*b* of the antenna member 32.

Figure 3D:
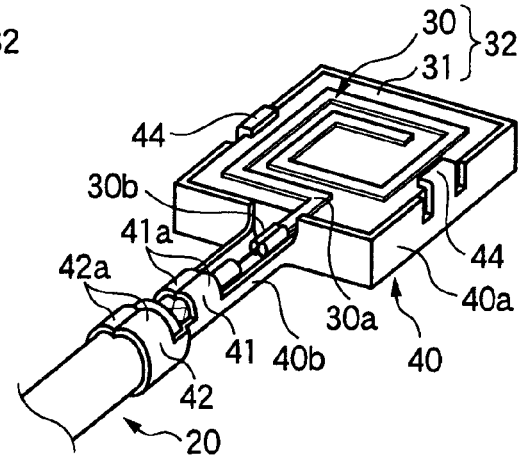
Figure 3E:
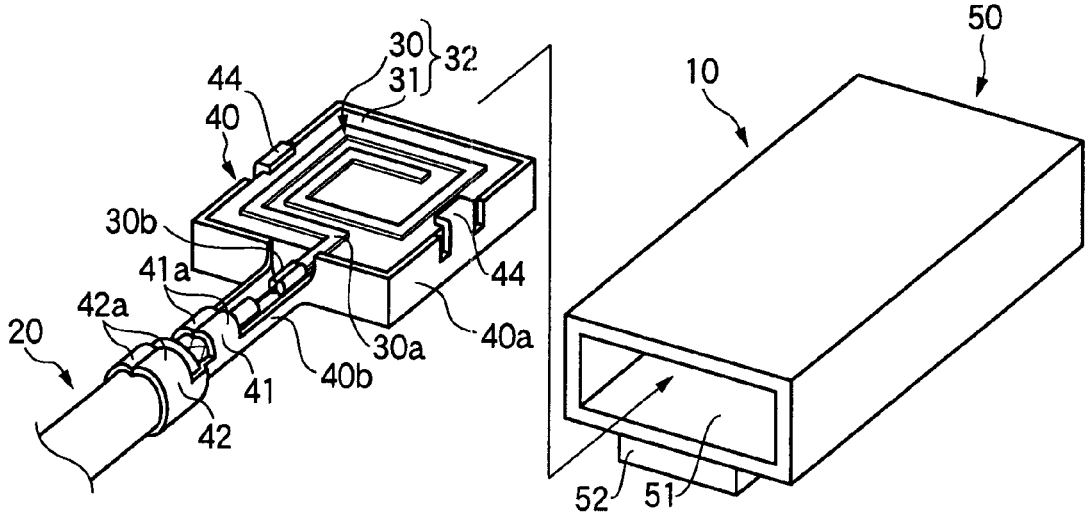
Figure 4:
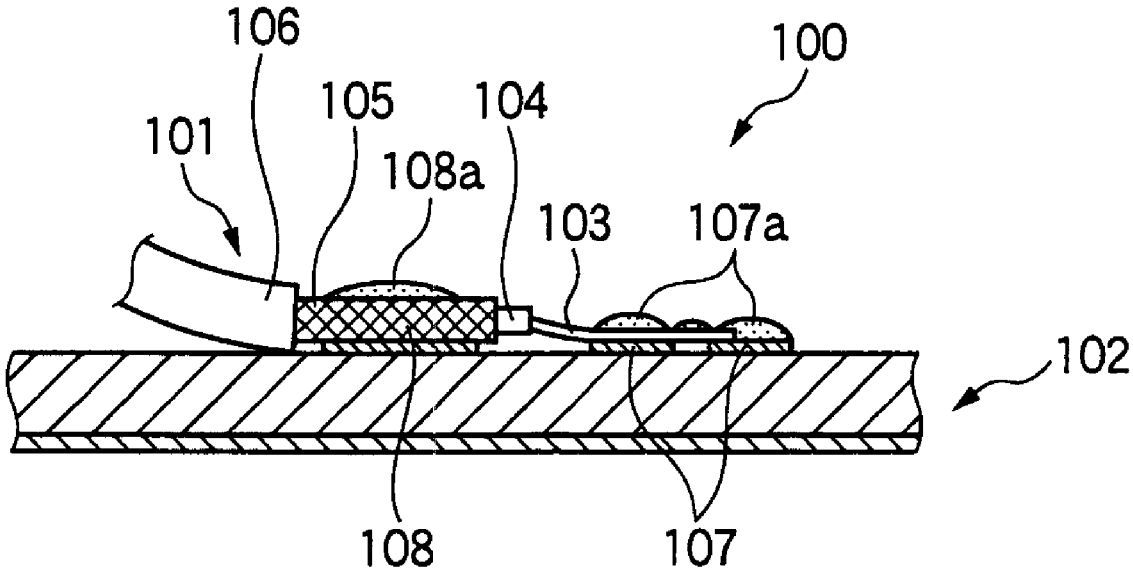
FIG. 4 is a cross-sectional view showing a conventional antenna connecting method.

Then, the pair of gripping piece portions 41*a* of the braided press-clamping portion 41, as well as the pair of gripping piece portions 42*a* of the outer sheath press-clamping portion 42, are pressed or crushed toward each other by the tool as shown in FIG. 3D, so that the braid 23 is grasped by the ground terminal 40, and also the coaxial cable 20 is grasped by the ground terminal 40 (This is a grasping step.).

Then, the ground terminal 40 is received in the ground terminal receiving portion 51 of the connector housing 50, and part of the bracket 60 is received in the bracket receiving portion 52, so that the bracket contact portion 43 is held in contact with the ground portion 61 of the bracket 60, thereby electrically connecting the ground terminal 40 to the bracket 60 (This is the bracket connecting step.), thus connecting the antenna device 10.

Therefore, when the antenna device 10 is to be mounted on a predetermined portion, for example, of the body of the automobile, part of the bracket 60 located at a predetermined position is inserted into the bracket receiving portion 52 of the connector housing 50 (having the ground terminal 40 received in the ground terminal receiving portion 51), and the bracket contact portion 43 of the ground terminal 40 is contacted with the ground portion 61 of the bracket 60, and hence is grounded (see FIG. 2B), and therefore the antenna device 10 can be connected more easily in a shorter time.

Furthermore, in this structure, the ground terminal 40 is grounded by contacting the bracket contact portion 43 thereof with the ground portion 61 of the bracket 60, and therefore the area of contact of the ground terminal 40 with the ground portion of the bracket 60 can be increased.

In the above antenna connecting structure and the above antenna connecting method, the antenna member 32 is connected by press-clamping to the core wire 21 of the coaxial cable 20, and the braided press-clamping portion 41 of the ground terminal 40 (having the antenna member 32 received therein) is connected by press-clamping to the braid 23 of the coaxial cable 20, and therefore the antenna member 32 and the ground terminal 40 can be connected to the coaxial cable 20 without the need for paying any attention to the amount of solder as in the conventional connecting structure using the soldering operation.

Furthermore, the antenna portion 30*a* of the antenna conductor 30 is insert-molded in the dielectric body 31, and therefore the deformation of the antenna portion 30*a* can be prevented, and a change in inductance value can be greatly suppressed, and a variation in receiving characteristics of the final products (antenna devices 10) can be suppressed.

Furthermore, the antenna device 10 is constructed such that the antenna member 32 and the ground terminal 40 are received in the connector housing 50, and therefore by inserting the bracket 60 (located, for example, at a predetermined portion of the body of the automobile) into the connector housing 50, the antenna device 10 can be easily mounted in a predetermined position.

The antenna device of the invention and the antenna connecting method of the invention are not limited to the above embodiment, and suitable modifications, improvements, etc., can be made. For example, the shape of each of the above antenna conductor 30, antenna member 32 and ground terminal 40 is merely one example, and they are not limited to their respective shapes shown in the drawings.

In the above embodiment, although the shielding member of the coaxial cable is composed solely of the braid interposed between the inner sheath and the outer sheath, the shielding member is not limited to this construction, and the shielding member may include such a braid, and a metal foil (such as an aluminum foil, a copper foil, etc.) wound either around the outer periphery of the braid or around the outer periphery of the inner sheath. Furthermore, the shielded cable may include a spiral shielding wire instead of the braid.

What is claimed is:

1. An antenna connecting structure, comprising:

a shielded cable including: a core wire; an inner sheath covering an outer peripheral surface of the core wire and extending in a longitudinal direction of the core wire; a shielding member covering an outer peripheral surface of the inner sheath and extending in the longitudinal direction; and an outer sheath covering an outer peripheral surface of the shielding member and extending in the longitudinal direction, wherein one end portions of the core wire, the inner sheath and the shielding member are exposed at one end portion of the shielded cable in the longitudinal direction;

an antenna member including: a dielectric body; and an antenna conductor which has an antenna portion molded in the dielectric body, and a terminal portion formed integrally with the antenna portion and press-clamped or press-contacted to the one end portion of the core wire to be electrically connected to the core wire; and a ground terminal, made of conductive metal, including: a receiving portion for holding the dielectric body so that the ground terminal is not in contact with the antenna conductor and the core wire; a shielding member grasping portion for grasping one end portion of the shielding member to electrically connect to the shielding member.

2. The antenna connecting structure according to claim 1, wherein the ground terminal includes an outer sheath grasping portion for grasping one end portion of the outer sheath.

3. The antenna connecting structure according to claim 1, wherein a holding claw is provided on the receiving portion to hold the antenna member.

4. The antenna connecting structure according to claim 1, further comprising a connector housing which receives the ground terminal and part of a bracket electrically connected to an external ground, wherein a bracket contact portion is formed on the ground terminal; and wherein when the ground terminal and the bracket are received in the connector housing, the bracket contact portion contacts the bracket so that the ground terminal is electrically connected to the bracket.

5. An antenna connecting method, comprising:

preparing a shielded cable including a core wire; an inner sheath covering an outer peripheral surface of the core wire and extending in a longitudinal direction of the core wire; a shielding member covering an outer peripheral surface of the inner sheath and extending in the longitudinal direction; and an outer sheath covering an outer peripheral surface of the shielding member and extending in the longitudinal direction, wherein one end portions of the core wire, the inner sheath and the shielding member are exposed at one end portion of the shielded cable in the longitudinal direction, preparing an antenna member including: a dielectric body; and an antenna conductor which has an antenna portion molded in the dielectric body and a terminal portion formed integrally with the antenna portion, and preparing a ground terminal, made of conductive metal, including: a receiving portion for holding the dielectric body so that the ground terminal is not in contact with the antenna conductor and the core wire; and a shielding member grasping portion for grasping the one end portion of the shielding member to electrically connect to the shielding member;

electrically connecting the core wire to the terminal portion of the antenna member by press-clamping or press-contacting;

attaching the ground terminal to the dielectric body so that the dielectric body is received in the receiving portion; and grasping the shielding member by the shielding member grasping portion.

6. The antenna connecting method according to claim 5, further comprising:

preparing the ground terminal provided with an outer sheath grasping portion for grasping one end portion of the outer sheath; and grasping the outer sheath by the outer sheath grasping portion.

7. The antenna connecting method according to claim 5, further comprising:

preparing the ground terminal provided with a bracket contact portion;

receiving the ground terminal and part of a bracket connected to an external ground in a connector housing; and contacting the bracket contact portion with the bracket so as to electrically connect the ground terminal to the bracket.

* * * * *